United States Patent [19]

Meacham et al.

[11] Patent Number: 4,937,559

[45] Date of Patent: Jun. 26, 1990

[54] AIR CONDITIONER DRAIN BLOCKAGE ALARM

[76] Inventors: Huey W. Meacham, 9532 Wesso Cir., Shreveport, La. 71118; Bradley J. Meacham, 2618 Drexel St., Shreveport, La. 71108

[21] Appl. No.: 396,112

[22] Filed: Aug. 21, 1989

[51] Int. Cl.[5] ..... G08B 21/00

[52] U.S. Cl. ..... 340/618; 340/616; 200/61.04; 62/129

[58] Field of Search ..... 340/604, 605, 616, 618, 340/623, 624, 625; 62/188; 200/61.04; 73/305, 307, 308

[56] References Cited

U.S. PATENT DOCUMENTS

| | | | |
|---|---|---|---|
| 3,757,316 | 9/1973 | Fiorenzo | 340/608 |
| 4,091,365 | 5/1978 | Allen | 340/625 X |
| 4,633,673 | 1/1987 | Morrison et al. | 62/129 |
| 4,787,212 | 11/1988 | Hessey | 62/188 |

*Primary Examiner*—Joseph A. Orsino, Jr.

*Assistant Examiner*—Jeffery A. Hofsass

*Attorney, Agent, or Firm*—John M. Harrison

[57] ABSTRACT

An air conditioner drain blockage alarm system which is designed for application to both horizontally and vertically-mounted heating and air conditioning units, which alarm includes in a preferred embodiment, both a normally open drain line liquid level switch and a normally closed drain pan liquid level switch for sensing blockage of a drain line in both the drain line itself and in the condensate drain pan which collects condensate from the air conditioning unit. In addition to the drain line and drain pan liquid level switches, the system is characterized by an alarm which audibly indicates a high water condition in either the condensate drain pan or the drain line and a manual override switch for manually silencing the alarm. In a preferred embodiment, the system is wired through the existing thermostat in the heating and air conditioning unit to facilitate deactivating the air conditioning system by the drain pan liquid level switch when the condensate drain pan is subject to overflow.

17 Claims, 1 Drawing Sheet

AIR CONDITIONER DRAIN BLOCKAGE ALARM

FIELD OF THE INVENTION

This invention relates to horizontally and vertically-mounted heating and air-conditioning systems and more particularly, to an alarm system which features a normally open drain line liquid level switch and a normally closed drain pan liquid level switch to provide early warning of air conditioning condensate drain line stoppage and stop the air conditioning unit, respectively. Under circumstances where the drain line serving the evaporator condensate drain pan is plugged, the drain pan liquid level switch operates to stop the blower and the condensing unit if the alarm activated by the drain line liquid level switch goes unnoticed or if the structure is unoccupied. This lack of attention can occur as the drain line liquid level switch system sounds the alarm upon sensing water rising in the condensate drain line while the air conditioning unit continues to run. A manual override switch is provided in the system in order to terminate the alarm while waiting for service on the unit. When the water level reaches approximately ¾ of an inch in the evaporator condensate drain pan, the drain pan liquid level switch automatically stops the air conditioning unit to prevent water damage to the blower motor, carpet, wall, ceiling and household goods.

One of the problems which exists in household and commercial air conditioning and heating units is that of plugging of the evaporator condensate line, which results in water overflowing the condensate drain pan and causing damage to household goods and furnishings, as well as the blower motor of the unit and the floors, carpet, walls and ceiling of the structure. One of the causes of drain line blockage is the development of algae, which ultimately blocks the condensate drain line and permits water to build up and overflow the condensate drain pan. A common practice which is designed to prevent the accumulation of algae in the condensate drain line is pouring of a bleach solution in the standpipe which communicates with the condensate drain line, in order to prevent the formation of algae therein. However, this procedure must be undertaken at regular intervals or the algae will ultimately develop and block the condensate drain line to cause the undesirable overflow.

DESCRIPTION OF THE PRIOR ART

Various types of alarm systems are known in the art for use in various appliances. U.S. Pat. No. 1,384,767, dated July 19, 1921, to W. M. Kurz, details an "Indicator and Alarm for Refrigerator Drip Pans". The Kurz alarm includes a fulcrumed lever having a float attached to one end for insertion in the refrigerator drip pan and the opposite end attached to an alarm, wherein rising of the float pursuant to water accumulation in the drip pan activates the alarm. U.S. Pat. No. 2,142,927, dated Jan. 3, 1939, to F. A. Walker, details a "Washing Apparatus", which includes a dishwashing device provided with means for emitting a signal to warn the attendant when a predetermined quantity of liquid has been supplied to the washing chamber. In one embodiment, an incandescent light is provided for indicating when a predetermined quantity of water has been supplied to the washing chamber and the signal lamp is connected to a liquid flow switch which is activated when the predetermined quantity of liquid has been supplied. U.S. Pat. No. 4,080,985, dated Mar. 28, 1978, to John Eagle, details a "Water Level Alarm Apparatus". The apparatus includes a float slidably confined within a tube, which tube is buoyantly positioned as determined by the level of water located within a container such as a bathtub, swimming pool or the like. Upon reaching an upper position, the float closes a set of stationary contacts, which action in turn completes a series of electrical circuits, including an alarm bell and a battery. Simultaneously with the closing of the contacts, an electrically-operated solenoid valve, disposed in series with a pipe communicating to a water source used to fill the container, closes, to halt any further increase in the water level within the container. Altering the length of the float or varying the position of the contacts relative to the mouth of the container adjusts the maximum level of water that may be disposed within the container. U.S. Pat. No. 4,195,374, dated Apr. 1, 1980, to Earl L. Morris, details a "Plumbing Fixture Overflow Limiter". The device includes a toilet bowl having a flushing rim adapted to be coupled to a water supply pipe, an electrically controlled flushing valve for controlling the flow of water in the water supply pipe, a source of electricity for operating the flushing valve, a switch for controlling the flow of electricity to the flushing valve, a blow-out jet pipe coupled to the trap in the toilet bowl and adapted to be coupled to the water supply pipe and a hollow adaptor having at least four openings therein, wherein one opening is coupled to a water supply pipe, a second opening of which is coupled to the blow-out jet pipe and a third opening being coupled to the flushing rim, so that when water flows therein, water also flows in the adaptor by means of the opening coupled to the flushing rim. The adaptor is further provided with a weir for dividing the openings coupled to the water supply pipe and the blow-out jet pipe from the other openings therein. Finally, an electrical probe is mounted in the remaining opening in the adaptor, thereby disposing it below the top of the weir. The electrical probe is operably connected to a detection circuit which operates to prevent electrical actuation of the flushing valve when water is in the flushing rim and in the adaptor about the probe, and completes the circuit between the probe and electrical around. A "Bath Water Level Control System" is detailed in U.S. Pat. No. 4,258,444, dated Mar. 31, 1981, to Willie Orszullok. The water level control system is used with bath tubs and includes a capacitive proximity switch disposed external to one wall of a bath tub. The vertical position of the switch is adjustable and the switch generates a signal when the water level is approximately equal to that of the switch. The signal is used to control a water supply solenoid and/or an alarm indication. U.S. Pat. No. 4,814,752, dated Mar. 21, 1989, to W. L. Lehman, outlines an "Overflow Water Containment Pedestal With High Level Sensor and Shut-Off". The device is characterized by a washer-type machine containment pedestal tray having a sensor-shutoff device for removing power from the washing machine. The invention provides a pedestal for mounting a washing machine thereon and the device is capable of containing overflow water, should the machine malfunction. A collection of water in the containment pedestal tray actuates a float, which in turn trips an electrical switch to remove operative power from the washing machine motor, thus stopping the overflow. Adjunct means are used on the switch for sounding an audible alarm to operating personnel.

It is an object of this invention to provide a system for warning of air conditioning condensate drain line blockage, which system is characterized in a most preferred embodiment by a normally open condensate drain line liquid level switch and a normally closed drain pan liquid level switch situated in the condensate drain line and drain pan, respectively, of an air conditioning system, in order to activate an alarm and ultimately automatically terminate operation of the unit, respectively, when the drain line becomes blocked.

Another object of this invention is to provide an alarm and cut-off device for providing early warning of air conditioning condensate drain line blockage, which device includes at least one, or both, of a normally open drain line liquid level switch and a normally closed drain pan liquid level switch which are electrically connected to an alarm and a thermostat, respectively, in order to sound the alarm and stop the air conditioning unit, respectively, when the drain line is blocked and water rises either in the drain line and the condensate drain pan.

Still another object of this invention is to provide a central air conditioning condensate drain blockage warning and lock-out switch kit which can be added to existing vertically and horizontally-mounted heating and air conditioning units, in order to facilitate sounding an audible alarm or activating a visual alarm by closing of a normally open drain line liquid level switch and terminating operation of the air conditioning unit by opening of a normally closed drain pan liquid level switch, in the event that the drain line becomes blocked.

SUMMARY OF THE INVENTION

These and other objects of the invention are provided in an alarm and shutoff system for both horizontally and vertically-mounted heating and air conditioning units, which system is characterized by a normally open drain line liquid level switch located in the drain line of the unit for sounding an audible alarm and/or activating a visual alarm in the event of rising water in the drain line and a normally closed drain pan liquid level sensing switch located in the drain pan of the unit and electrically connected to the thermostat in the structure, for terminating operation of the unit in the event of a blocked drain line. In a preferred embodiment of the invention both the drain line liquid level switch and the drain pan liquid level switch are characterized by a magnetic, reed-type, float-mounted switches, in order to provide the desired switching function with minimum malfunction and maintenance.

BRIEF DESCRIPTION OF THE DRAWING

The invention will be better understood by reference to the accompanying drawing wherein.

DESCRIPTION OF THE PREFERRED EMBODIMENTS

Figure 1:
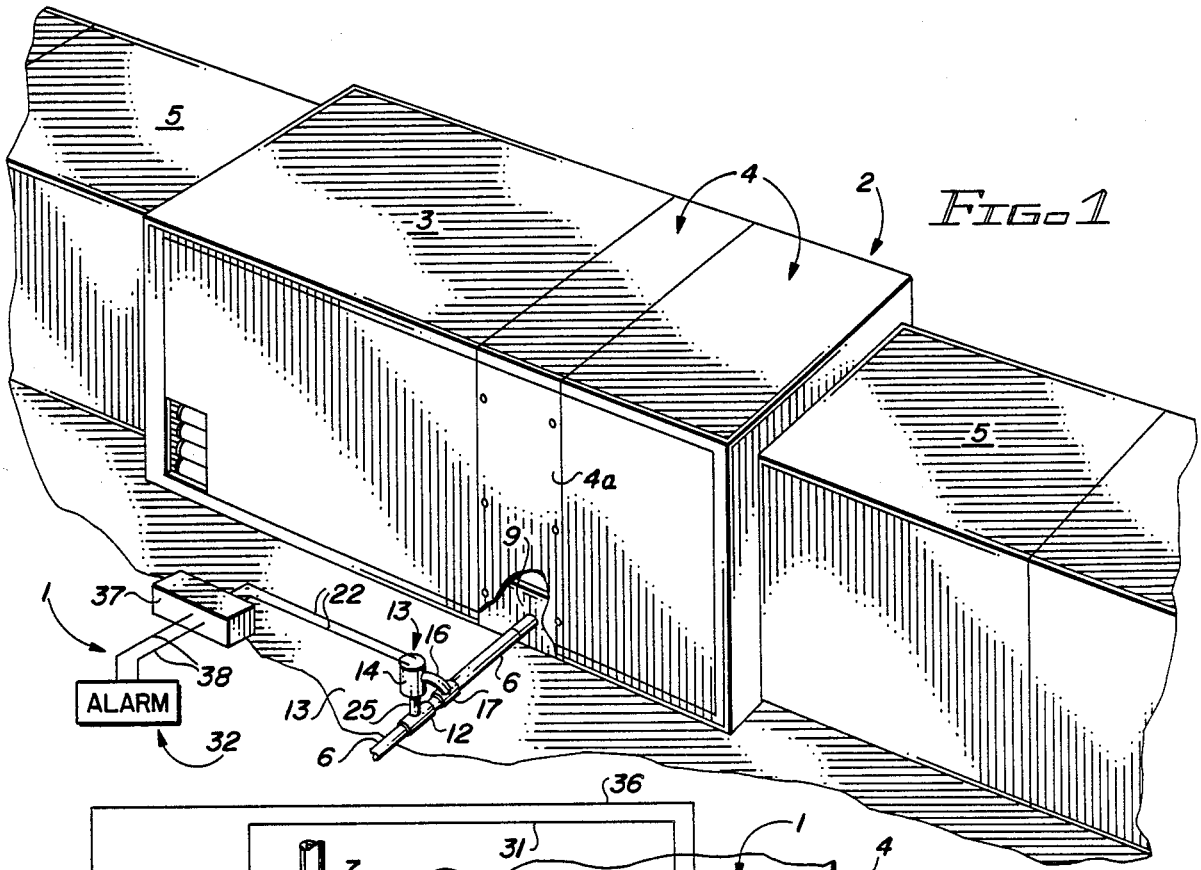
FIG. 1 is a perspective view, partially in section, of a horizontally-mounted heating and air conditioning unit, illustrating a typical horizontal installation for the air conditioner drain blockage alarm of this invention.

Referring initially to FIG. 1 of the drawing, in a preferred embodiment of the invention the drain blockage alarm of this invention is generally illustrated by reference numeral 1, and includes a normally open drain line liquid level switch 13, installed in the horizontal drain line 6 which extends from the condensor housing 4 of the horizontal furnace 2. The condensor housing 4 is attached to the fan housing 3 of the horizontal furnace 2 and air handling ducts 5 are secured to the condensor housing 4 and the fan housing 3 of the horizontal furnace 2 in conventional fashion. The horizontal drain line 6 projects from a condensate drain pan 9, located in the bottom of the condensor housing 4, through the side panel 4a of the condensor housing 4, in order to drain condensate from the coils of a condensor (not illustrated) located in the condensor housing 4. As further illustrated in FIG. 1, the drain line liquid level switch 13 component of the drain blockage alarm 1 is characterized by a vertically oriented, cylindrically-shaped switch housing 14, having a pair of contact leads 22 extending from the top thereof, which contact leads 22 extend to an equipment cabinet 37, and electrically connect the drain line liquid level switch 13 to other electrical components (not illustrated) located in the equipment cabinet 37. Cabinet leads 38 connect these electrical components to an audible alarm 32, as hereinafter further described. The switch housing 14 receives one end of a nipple 25, which connects the switch housing 14 to the horizontal drain line 6 and a vent line 16 connects the upper end of the switch housing 14 to a vent tee 17, also provided in the horizontal drain line 6, as further illustrated in FIG. 1. Accordingly, closing of the normally open drain line liquid level switch 13 by water rising in the horizontal drain line 6 and filling the nipple 25 and switch housing 14 through the housing nipple 34 due to blockage of the horizontal drain line 6, causes the alarm 32 to sound, as further hereinafter described.

Figure 2:
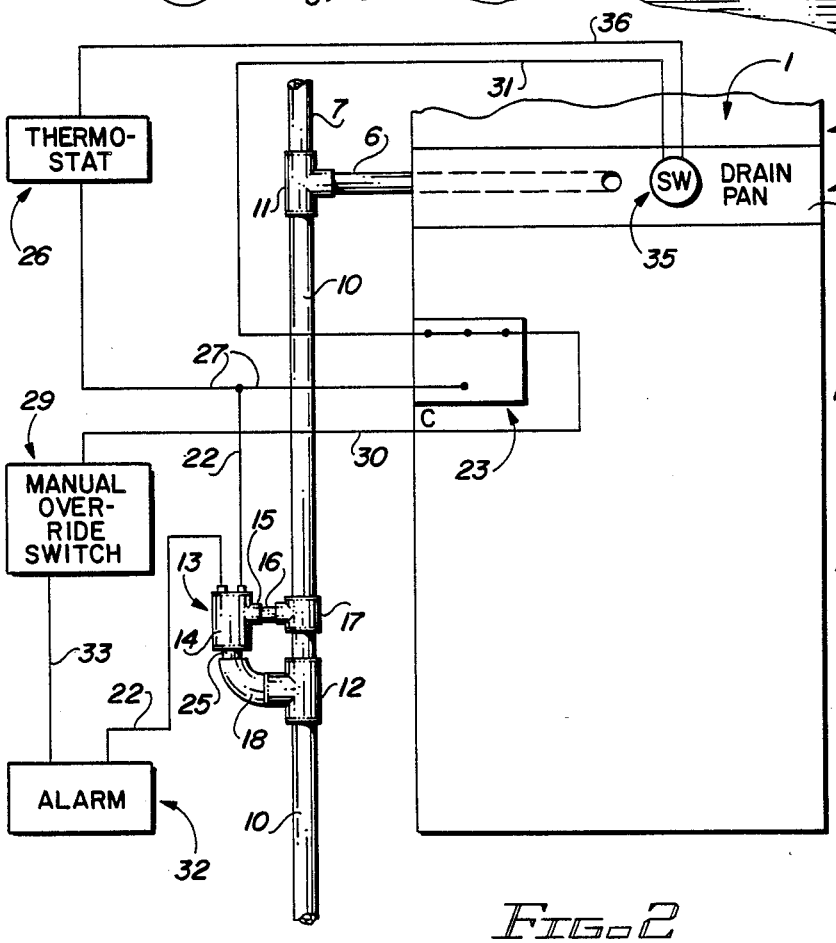
FIG. 2 is a schematic diagram of a typical vertical installation for the air conditioner drain blockage alarm of this invention mounted on a vertical heating and air conditioning unit.

Referring now to FIGS. 1 and 2 of the drawing, in another preferred embodiment of the invention, a vertical furnace 8 is illustrated with a condensate drain pan 9 provided in the top end thereof beneath the condensor coils of a condensor (not illustrated), located in the condensor housing 4. A normally closed drain pan liquid level switch 35 is installed in the condensate drain pan 9, in order to sense a level of water which may rise in the condensate drain pan 9. A horizontal drain line 6 extends from the drain pan 9 to a top tee 11, which supports a vertically-oriented standpipe 7 and connects the standpipe 7 to a length of vertically-disposed drain line 10. A drain line liquid level switch 13 is mounted parallel to the vertical drain line 10 and in a most preferred embodiment of the invention, the drain line liquid level switch 13 and the drain pan liquid level switch 35 illustrated in FIG. 2 are identical in construction to the drain line liquid level switch 13 illustrated in FIG. 1. Accordingly, the drain line liquid level switch 13 illustrated in FIG. 2 is provided with a switch housing 14, having contact leads 22 extending from the top thereof and fitted with a vent nipple 15, which secures a vent line 16 to a corresponding vent tee 17, located in the vertical drain line 10. However, it will be appreciated that the drain pan switch 35 is characterized by a normally closed switch, while the drain line liquid level switch 13 operates as a normally open switch, as hereinafter described. An elbow 18 and an elbow nipple 25 connect the bottom portion of the switch housing 14 to a bottom tee 12, mounted in the vertical drain line 10, as further illustrated in FIG. 2. A transformer 23 is provided as conventional equipment in both the horizontal furnace 2 and the vertical furnace 8, in order to step-down current from household current to a selected system current for operation of the drain blockage alarm 1. Furthermore, an alarm 32 and a manual override switch 29, the latter of which operates to terminate the alarm 32, are also provided as additional elements in the drain blockage alarm 1, as illustrated in FIG. 2 and as hereinafter further described. As further illustrated in FIG. 2, one of the contact leads 22 extends as an electrical connection from the switch housing 14 to a transformer-thermostat lead 27, which in turn electrically links the conventional thermostat 26 to the conventional transformer 23. The other contact lead 22 electrically connects the switch housing 14 to the alarm 32 and an alarm-override switch lead 33 electrically connects the alarm 32 to the manual override switch 29. Furthermore, a transformer-override switch lead 30 extends in electrical connection from the manual override switch 29 to the transformer 23 and a transformer-drain pan switch lead 31 electrically connects the conventional transformer 23 to the drain pan switch 35. A thermostat-drain pan switch lead 36 electrically connects the drain pan switch 35 to the thermostat 26.

Figure 3:
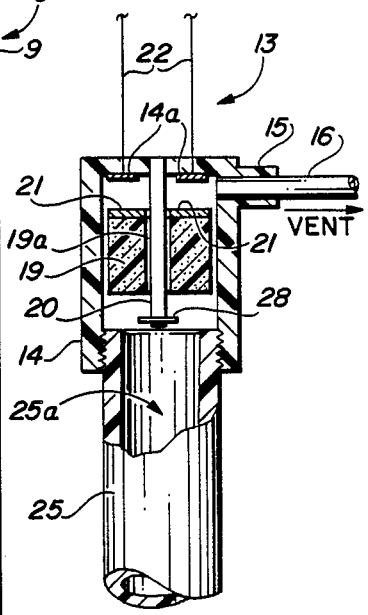
FIG. 3 is a sectional view of a preferred embodiment of the drain blockage liquid level alarm switch utilized in both the horizontal unit illustrated in FIG. 1 and the vertical unit illustrated in FIG. 2.

Referring now to FIG. 3 of the drawing, in a preferred embodiment of the invention the normally open drain line liquid level switches 13 in both the horizontal furnace 2 and the vertical furnace 8, as well as (the normally closed drain pan liquid level switch 35) illustrated in FIG. 2, are each characterized by a float 19, fitted with a float bore **19*a*, which receives a float pin 20, fixed inside the switch housing 14. Since the drain line liquid level switches 13 are each installed in a normally open configuration, a float contact 21 is located on the top end of the float 19 in alignment with a pair of housing contacts 14*a*, secured to the inside top surface of the switch housing 14. The contact leads 22 extend through the top of the switch housing 14 and are secured to the spaced housing contacts 14*a*, as illustrated. A retainer 28 is secured to the bottom end of the float pin 20 to facilitate disassembly of the float 19 from the float pin 20 for maintenance purposes. Accordingly, it will be appreciated by those skilled in the art that the float 19 is designed to slidably traverse the float pin 20 between the upper and lower ends of the switch housing 14, responsive to a level of water which may enter the switch housing 14 through the nipple bore 25*a* of the nipple 25. When the float 19 is floated upwardly into the extreme upper end of the switch housing 14, the float contact 21 touches the housing contacts 14*a* and completes the electrical circuit through the contact leads 22, thereby activating the drain blockage alarm 1**, as hereinafter further described.

It will be appreciated from a consideration of the simplified design of the normally open drain line switch 13 that many different switch designs are possible for completing the circuit between the respective contact leads 22 by contact with the rising float 19. For example, a conventional mechanical snap-action microswitch, as well as a magnetic reed-type float switch can be used in this capacity, in non-exclusive particular, according to the knowledge of those skilled in the art.

In operation, and referring again to FIGS. 1–3 of the drawing, under circumstances where a blockage occurs in the vertical drain line 10 below the bottom tee 12, illustrated in FIG. 2, or in the horizontal drain line 6 due to plugging of the horizontal drain line 6 beyond the drain line switch 13 as illustrated in FIG. 1, water cannot flow from the drain pan 9 in each case through the horizontal drain line 6 and the vertical drain line 10, respectively. Accordingly, water begins to rise in the vertical drain line 10 toward the bottom tee 12 illustrated in FIG. 2, as well as in the horizontal drain line 6 illustrated in FIG. 1. When the water rises in the nipple bore **25*a* of the nipple 25 and in the switch housing 14 of the respective normally open drain line liquid level switches 13, it causes the buoyant float 19 to also rise inside the corresponding switch housing 14, as illustrated in FIG. 3. When the float contact 21 touches the two housing contacts 14*a* positioned inside the switch housing 14, current is caused to flow through the contact leads 22 and through the transformer-thermostat lead 27 to the thermostat 26 and the transformer 23 and to the alarm 32, and from the alarm 32 through the alarm-override switch lead 33, to the manual override switch 29. This current causes the alarm 32 to sound under circumstances where the alarm 32 is audible, as in the case of a bell or like alarm, which alarm 32 can be silenced by manipulating the manual override switch 29. In the alarm circuit illustrated in FIG. 1, the manual override switch 29 can be located in the equipment cabinet 37, along with the conventional transformer 23, as desired, and the alarm 32 is caused to sound under the circumstances described above with respect to FIG. 1** by current determined by the transformer (not illustrated).

Referring again to FIGS. 1 and 2, under circumstances where the blockage in the horizontal and vertical drain lines 6 and 10, respectfully, occurs between the vent tee 17 and the condensate drain pan 9 and between the vent tee 17 and top tee 11, respectively, or when no one is in the structure to hear the sounding of the alarm 32, water will continue to build in the horizontal drain line 6 and the condensate drain pan 9 illustrated in FIG. 1 and upwardly in the vertical drain line 10 through the top tee 11 and the horizontal drain line 6 illustrated in FIG. 2, to fill the condensate drain pan 9. When approximately three-quarters of an inch of water rises in the condensate drain pan 9, (the normally closed drain pan liquid level switch 35) illustrated in FIG. 2 is opened. Current thus ceases to flow through the thermostat drain pan switch lead 36 and the transformer-drain pan switch lead 31 to the thermostat 26 and the transformer 23, respectively, as illustrated in FIG. 2, to automatically terminate operation of the blower and the air conditioner unit in the vertical furnace 8. This insures that the drain pan 9 will not continue to fill, overflow and cause damage to the blower motor, furnishings or in the structure. Referring again to FIG. 1 of the drawing, the condensate drain pan 9 can be fitted with a drain pan switch 35 in the same manner as illustrated in FIG. 2 and the drain blockage alarm 1 installed in the horizontal drain line 6 may include a thermostat 26, manual override switch 29 and transformer 23, all or some of which components can be located in the equipment cabinet 37, as desired.

While the drain line liquid level switches 13 in both the horizontal furnace 2 and the vertical furnace 8 have been illustrated as contact-type switches, it will be appreciated by those skilled in the art that the drain line liquid level switches 13 and the drain pan liquid level switch 35 are most preferably each characterized by a magnetic reed-type float switch. This switch can be adjusted from the normally open configuration illustrated in FIG. 3 to a normally closed configuration by reversing the position of the float 19 on the float pin 20, according to the knowledge of those skilled in the art. However, other liquid level-activating switches may also be utilized according to the knowledge of those skilled in the art as described above, in order to sense rising water level in the vertical drain line 10, horizontal drain line 6 and drain pan 9 of both the horizontal furnace 2 and the vertical furnace 8, respectively.

It will be further appreciated by those skilled in the art that the drain blockage alarm system of this invention is characterized by convenience and flexibility, in that it can be retrofitted to substantially any horizontal or vertical furnace, regardless of installation configuration or brand. Furthermore, the drain blockage alarm serves the dual purpose of sounding an audible alarm when the drain line is blocked and terminating operation of the blower and air conditioning system when the drain pan fills to a predetermined level. It will be further understood that a visual alarm such as a light can be provided in the system and may be activated, along with, or in lieu of an audible alarm, as the alarm 32, illustrated in FIGS. 1 and 2, under circumstances where either the drain line liquid level switch 13 or the drain pan liquid level switch 35 are activated, according to the teachings of this invention.

While the preferred embodiments of the invention have been described above, it will be recognized and understood that various modifications may be made therein and the appended claims are intended to cover all such modifications which may fall within the spirit and scope of the invention.

Having described my invention with the particularity set forth above, what is claimed is:

1. An air conditioner drain blockage alarm for an air conditioning unit having a thermostat, a transformer for reducing the electric current and voltage applied to the thermostat, a drain pan for collecting water condensate and a drain line attached to the drain pan for draining the water from the drain pan, said alarm comprising a normally open liquid level magnetic reed switch attached to the drain line in water-communication with the drain line, vent means provided in said normally open liquid level magnetic reed switch for venting air from said normally open liquid level magnetic reed switch and alarm means electrically connected to said normally open liquid level magnetic reed switch, whereby said alarm means is electrically activated when water fills said liquid level magnetic reed switch to a predetermined level responsive to blockage of the drain line and said normally open liquid level magnetic reed switch is closed, and a normally closed liquid level switch attached to said drain pan, said normally closed liquid level switch electrically connected to the thermostat and the transformer, whereby the thermostat is deactivated to terminate operation of the air conditioning unit when water rises to a predetermined level in the drain pan and opens said normally closed liquid level switch responsive to blockage of the drain line.

2. The air conditioner drain blockage alarm of claim 1 wherein said alarm means further comprises an audible alarm.

3. The air conditioner drain blockage alarm of claim 1 wherein said normally closed liquid level switch further comprises a magnetic reed switch.

4. The air conditioner drain blockage alarm of claim 1 further comprising a manual override switch electrically connected to the transformer and said alarm means for manually terminating operation of said alarm means.

5. The air conditioner drain blockage alarm of claim 4 wherein said alarm means further comprises an audible alarm.

6. The air conditioner drain blockage system of claim 4 wherein said alarm means further comprises a visual alarm.

7. The air conditioner drain blockage system of claim 4 wherein said alarm means further comprises an audible alarm and a visual alarm.

8. An air conditioner drain blockage alarm for an air conditioning unit having a thermostat, a transformer for reducing the electric current and voltage applied to the thermostat, a drain pan for collecting water and a drain line attached to the drain pan for draining water from the drain pan, said alarm comprising a normally open liquid level switch attached to the drain line in water-communication with the drain line; vent means extending from said normally open liquid level switch to the drain line for venting air from said normally open liquid level switch to the drain line; alarm means electrically connected to said normally open liquid level switch, whereby said alarm means is electrically activated when water fills said liquid level switch to a predetermined level responsive to blockage of the drain line and said normally open liquid level switch is closed; and a normally closed liquid level switch attached to said drain pan, said normally closed liquid level switch electrically connected to the thermostat and the transformer, whereby the thermostat is deactivated to terminate operation of the air conditioning unit when water rises to a predetermined level in the drain pan responsive to blockage of the drain line and said normally closed liquid level switch is opened.

9. The air conditioner drain blockage alarm of claim 8 wherein said normally open liquid level switch and said normally closed liquid level switch each further comprise a magnetic reed switch.

10. The air conditioner drain blockage alarm of claim 8 further comprising a manual override switch electrically connected to the transformer and said alarm means for manually terminating operation of said alarm means.

11. The air conditioner drain blockage alarm of claim 8 wherein said normally open liquid level switch and said normally closed liquid level switch each further comprise a magnetic reed switch and further comprising a manual override switch electrically connected to the transformer and said alarm means for manually terminating sounding of said alarm means.

12. The air conditioner drain blockage alarm of claim 11 wherein said alarm means further comprises an audible alarm.

13. The air conditioner drain blockage alarm of claim 11 wherein said alarm means further comprises a visual alarm.

14. The air conditioner drain blockage alarm of claim 11 wherein said alarm means further comprises an audible alarm and a visual alarm.

15. The air conditioner drain blockage system of claim 14 wherein said alarm means further comprises an audible alarm and a visual alarm.

16. An air conditioner drain blockage alarm for an air conditioning unit having a thermostat, a transformer for reducing the electric current and voltage applied to the thermostat, a drain pan for collecting water and a drain line attached to the drain pan for draining water from the drain pan, said alarm comprising a normally open magnetic reed float switch attached to the drain line in water-communication with the drain line; a vent line extending from said normally open magnetic reed float switch to the drain line for venting air from said normally open magnetic reed float switch to the drain line; alarm means electrically connected to said normally open magnetic reed float switch, whereby said alarm means is electrically activated when water fills said normally open magnetic reed float switch to a predetermined level responsive to blockage of the drain line and said normally open magnetic reed float switch is closed; and a normally closed magnetic reed float switch attached to said drain pan, said normally closed magnetic reed float switch electrically connected to the thermostat and the transformer, whereby the thermostat is deactivated to terminate operation of the air conditioning unit when water rises to a predetermined level in the drain pan responsive to blockage of the drain line and said normally closed magnetic reed float switch is opened.

17. The air conditioner drain blockage alarm of claim 16 wherein said alarm means further comprises an audible alarm.

* * * * *